United States Patent [19]

deVries et al.

[11] 4,370,246

[45] Jan. 25, 1983

[54] ANTIOXIDANT COMBINATIONS OF MOLYBDENUM COMPLEXES AND AROMATIC AMINE COMPOUNDS

[75] Inventors: Louis deVries, Greenbrae; John M. King, San Rafael, both of Calif.

[73] Assignee: Chevron Research Company, San Francisco, Calif.

[21] Appl. No.: 258,160

[22] Filed: Apr. 27, 1981

[51] Int. Cl.[3] ..... C10M 1/32; C10M 1/38; C10M 1/44; C10M 1/54

[52] U.S. Cl. ..... 252/46.4; 252/49.7; 252/50; 252/400 A; 252/400 R

[58] Field of Search ..... 252/46.4, 50, 400 R, 252/400 A, 49.7

[56] References Cited

U.S. PATENT DOCUMENTS

| | | | |
|---|---|---|---|
| 2,009,480 | 7/1935 | Craig | 252/50 |
| 3,210,281 | 10/1965 | Peeler | 252/50 |
| 3,944,492 | 3/1976 | Wheeler | 252/50 |
| 4,272,387 | 6/1981 | King et al. | 252/46.4 |

*Primary Examiner*—W. J. Shine

*Attorney, Agent, or Firm*—D. A. Newell; M. M. Whitney; V. J. Cavalieri

[57] ABSTRACT

An antioxidant additive combination for lubricating oils is prepared by combining (a) a sulfur containing molybdenum compound prepared by reacting an acidic molybdenum compound, a basic nitrogen compound, and a sulfur compound, with (b) an aromatic amine compound.

18 Claims, No Drawings

ANTIOXIDANT COMBINATIONS OF MOLYBDENUM COMPLEXES AND AROMATIC AMINE COMPOUNDS

FIELD OF THE INVENTION

This invention relates to new lubricating oil additives and lubricating oil compositions prepared therefrom. More specifically, it relates to new lubricating oil compositions containing an antioxidant additive combination of a sulfur containing molybdenum compound and an aromatic amine compound.

BACKGROUND OF THE INVENTION

Molybdenum disulfide has long been known as a desirable additive for use in lubricating oil compositions. However, one of its major detriments is its lack of oil solubility. Molybdenum disulfide is ordinarily finely ground and then dispersed in the lubricating oil composition to impart friction modifying and antiwear properties. Finely ground molybdenum disulfide is not an effective oxidation inhibitor in lubricating oils.

As an alternative to finely grinding the molybdenum disulfide, a number of different approaches involving preparing salts of molybdenum compounds have been tried.

In U.S. Pat. Nos. 4,263,152 and 4,272,387, both filed June 28, 1979, and of common inventive entity and assignee to this application, there is a teaching of a class of oil soluble sulfur containing molybdenum complexes prepared by reacting an acidic molybdenum compound, a basic nitrogen composition and a sulfur compound in the presence or absence of a polar promoter, respectively, to form molybdenum and sulfur containing complexes which are reported therein as useful for inhibiting oxidation, imparting antiwear and extreme pressure properties, and/or modifying the friction properties of a lubricating oil. It has now been discovered that lubricating oils are more effectively stabilized against oxidation when said complexes are used in combination with an aromatic amine compound.

SUMMARY OF THE INVENTION

It has now been found that a lubricating oil additive which effectively stabilizes a lubricating oil against oxidation can be prepared by combining (a) a sulfur containing molybdenum compound prepared by reacting an acidic molybdenum compound, a basic nitrogen compound and a sulfur compound, preferably in the presence of a polar promoter, with (b) an aromatic amine compound.

More specifically, this invention is directed to a lubricating oil additive comprising a combination of (a) an oil soluble sulfur containing molybdenum complex prepared by (1) reacting an acidic molybdenum compound and a basic nitrogen compound selected from the group consisting of a succinimide, carboxylic acid amide, Mannich base, phosphonamide, thiophosphonamide, phosphoramide, dispersant viscosity index improvers, or mixtures thereof to form a molybdenum complex wherein from 0.01 to 2 atoms of molybdenum are present per basic nitrogen atom, and (2) reacting said complex with a sulfur containing compound in an amount to provide 0.1 to 4 atoms of sulfur per atom of molybdenum, and (b) an oil soluble aromatic amine compound or mixture thereof, wherein the aromatic amine compound of component (b) is present in an amount of from 0.02 to 10 parts by weight per part by weight of the sulfur containing molybdenum complex of component (a).

DETAILED DESCRIPTION OF THE INVENTION

Lubricating oil compositions containing the additive combination prepared as disclosed herein are effective as either fluid and grease compositions (depending upon the specific additive or additives employed) for inhibiting oxidation, imparting antiwear and extreme pressure properties, and/or modifying the friction properties of the oil which may, when used as a crankcase lubricant, lead to improved mileage.

The precise molecular formula of the molybdenum compositions of component (a) of the combination is not known with certainty; however, they are believed to be compounds in which molybdenum, whose valences are satisfied with atoms of oxygen or sulfur, is either complexed by or the salt of one or more nitrogen atoms of the basic nitrogen containing composition used in the preparation of these compositions. These molybdenum complexes which are described in U.S. applications Ser. Nos. 52,696 and 52,699, both filed June 24, 1979 are incorporated herein by reference.

The molybdenum compounds used to prepare the sulfur containing molybdenum compounds of component (a) of this invention are acidic molybdenum compounds. By acidic is meant that the molybdenum compounds will react with a basic nitrogen compound as measured by ASTM test D-664 or D-2896 titration procedure. Typically these molybdenum compounds are hexavalent and are represented by the following compositions: molybdic acid, ammonium molybdate, molybdenum salts such as $MoOCl_4$, $MoO_2Br_2$, $Mo_2O_3Cl_6$, molybdenum trioxide or similar acidic molybdenum compounds. Preferred acidic molybdenum compounds are molybdic acid, ammonium molybdate, and molybdenum trioxide. Particularly preferred are molybdic acid and ammonium molybdate.

The basic nitrogen compound must have a basic nitrogen content as measured by ASTM D-664 or D-2896. It is preferably oil-soluble. Typical of such compositions are succinimides, carboxylic acid amides, hydrocarbyl monoamines, hydrocarbon polyamines, Mannich bases, phosphonamides, thiophosphonamides, phosphoramides, dispersant viscosity index improvers, and mixtures thereof. These basic nitrogen containing compounds are described below (keeping in mind the reservation that each must have at least one basic nitrogen). Any of the nitrogen containing compositions may be after treated with e.g., boron, using procedures well known in the art so long as the compositions continue to contain basic nitrogen. These after treatments are particularly applicable to succinimides and Mannich base compositions.

The mono and polysuccinimides that can be used to prepare the lubricating oil additives described herein are disclosed in numerous references and are well known in the art. Certain fundamental types of succinimides and the related materials encompassed by the term of art "succinimide" are taught in U.S. Pat. Nos. 3,219,666; 3,172,892; and 3,272,746, the disclosures of which are hereby incorporated by reference. The term "succinimide" is understood in the art to include many of the amide, imide, and amidine species which are also formed by this reaction. The predominant product however is a succinimide and this term has been generally accepted as meaning the product of a reaction of an alkenyl substituted succinic acid or anhydride with a nitrogen containing compound. Preferred succinimides, because of their commercial availability, are those succinimides prepared from a hydrocarbyl succinic anhydride, wherein the hydrocarbyl group contains from about 24 to about 350 carbon atoms, and an ethylene amine, said ethylene amines being especially characterized by ethylene diamine, diethylene triamine, triethylene tetraamine, and tetraethylene pentamine. Particularly preferred are those succinimides prepared from polyisobutenyl succinic anhydride of 70 to 128 carbon atoms and tetraethylene pentaamine or triethylene tetraamine or mixtures thereof.

Also included within the term succinimide are the co-oligomers of a hydrocarbyl succinic acid or anhydride and a polysecondary amine containing at least one tertiary amino nitrogen in addition to two or mor secondary amino groups. Ordinarily this composition has between 1,500 and 50,000 average molecular weight. A typical compound would be that prepared by reacting polyisobutenyl succinic anhydride and ethylene dipiperazine. Compositions of this type are disclosed in U.S. Ser. No. 816,063, filed July 15, 1977, now abandoned, the disclosure of which is hereby incorporated by reference.

Carboxylic amide compositions are also suitable starting materials for preparing the products of this invention. Typical of such compounds are those disclosed in U.S. Pat. No. 3,405,064, the disclosure of which is hereby incorporated by reference. These compositions are ordinarily prepared by reacting a carboxylic acid or anhydride or ester thereof, having at least 12 to about 350 aliphatic carbon atoms in the principal aliphatic chain and, if desired, having sufficient pendant aliphatic groups to render the molecule oil soluble with an amine or a hydrocarbyl polyamine, such as an ethylene amine, to give a mono or polycarboxylic acid amide. Preferred are those amides prepared from (1) a carboxylic acid of the formula $R^2COOH$, where $R^2$ is $C_{12-20}$ alkyl or a mixture of this acid with a polyisobutenyl carboxylic acid in which the polyisobutenyl group contains from 72 to 128 carbon atoms and (2) an ethylene amine, especially triethylene tetraamine or tetraethylene pentaamine or mixtures thereof.

Another class of compounds useful for supplying basic nitrogen are the Mannich base compositions. These compositions are prepared from a phenol or $C_{9-200}$ alkylphenol, an aldehyde, such as formaldehyde or formaldehyde precursor such as paraformaldehyde, and an amine compound. The amine may be a mono or polyamine and typical compositions are prepared from an alkylamine, such as methylamine or an ethylene amine, such as, diethylene triamine, or tetraethylene pentaamine and the like. The phenolic material may be sulfurized and preferably is a $C_{80-100}$ alkylphenol, dodecylphenol or a $C_{8-10}$ alkylphenol. Typical Mannich bases which can be used in this invention are disclosed in U.S. Pat. No. 4,157,309 and U.S. Pat. Nos. 3,649,229; 3,368,972; and 3,539,663, the disclosures of which are hereby incorporated by reference. The last application discloses Mannich bases prepared by reacting an alkylphenol having at least 50 carbon atoms, preferably 50 to 200 carbon atoms with formaldehyde and an alkylene polyamine $HN(ANH)_nH$ where A is a saturated divalent alkyl hydrocarbon of 2 to 6 carbon atoms and n is 1–10 and where the condensation product of said alkylene polyamine may be further reacted with urea or thiourea. The utility of these Mannich bases as starting materials for preparing lubricating oil additives can often be significantly improved by treating the Mannich base using conventional techniques to introduce boron into the composition.

Another class of composition useful for preparing the additives of this invention are the phosphoramides and phosphonamides such as those disclosed in U.S. Pat. Nos. 3,909,430 and 3,968,157 the disclosures of which are hereby incorporated by reference. These compositions may be prepared by forming a phosphorus compound having at least one P-N bond. They can be prepared, for example, by reacting phosphorus oxychloride with a hydrocarbyl diol in the presence of a monoamine or by reacting phosphorus oxychloride with a difunctional secondary amine and a monofunctional amine. Thiophosphoramides can be prepared by reacting an unsaturated hydrocarbon compound containing from 2 to 450 or more carbon atoms, such as polyethylene, polyisobutylene, polypropylene, ethylene, 1-hexene, 1,3-hexadiene, isobutylene, 4-methyl-1-pentene, and the like, with phosphorus pentasulfide and nitrogen containing compound as defined above, particularly an alkylamine, alkyldiamine, alkylpolyamine, or an alkyleneamine, such as ethylene diamine, diethylene triamine, triethylene tetraamine, tetraethylene pentaamine, and the like.

Another class of nitrogen containing compositions useful in preparing the molybdenum compositions of this invention includes the socalled dispersant viscosity index improvers (VI improvers). These VI improvers are commonly prepared by functionalizing a hydrocarbon polymer, especially a polymer derived from ethylene and/or propylene, optionally containing additional units derived from one or more comonomers such as alicyclic or aliphatic olefins or diolefins. The functionalization may be carried out by a variety of processes which introduce a reactive site or sites which usually has at least one oxygen atom on the polymer. The polymer is then contacted with a nitrogen containing source to introduce nitrogen containing functional groups on the polymer backbone. Commonly used nitrogen sources include any basic nitrogen compound especially those nitrogen containing compounds and compositions described herein. Preferred nitrogen sources are alkylene amines, such as ethylene amines, alkyl amines, and Mannich bases.

Preferred basic nitrogen compounds for use in this invention are succinimides, carboxylic acid amides, and Mannich bases.

The sulfur sources used to prepare the oil soluble sulfur containing molybdenum complexes of component (a) are sulfur compounds which are reactive with the intermediate molybdenum complex prepared from the acidic molybdenum compound and the basic nitrogen compound and capable of incorporating sulfur into the final product.

Representative sulfur sources used to prepare the molybdenum complexes of component (a) are sulfur, hydrogen sulfide, sulfur monochloride, sulfur dichloride, phosphorus pentasulfide, alkyl and aryl sulfides and polysulfides of the formula $R_2S_x$ where R is hydrocarbyl, preferably $C_{1-40}$ alkyl, and x is at least 2, inorganic sulfides and polysulfides such as $(NH_4)_2S_x$, where x is at least 1, thioacetamide, thiourea, and mercaptans of the formula RSH where R is as defined above. Also useful as sulfurizing agents are traditional sulfur-containing antioxidants such as wax sulfides and polysulfides, sulfurized olefins, sulfurized carboxylic acid esters, sulfurized ester-olefins, sulfurized alkylphenols and the metal salts thereof, and the reaction product of an olefin and sulfurized alkylphenol.

The sulfurized carboxylic acid esters are prepared by reacting sulfur, sulfur monochloride, and/or sulfur dichloride with an unsaturated ester under elevated temperatures. Typical esters include $C_1$–$C_{20}$ alkyl esters of $C_3$–$C_{24}$ unsaturated acids, such as palmitoleic, oleic, ricinoleic, petroselinic, vaccenic, linoleic, linolenic, oleostearic, licanic, paranaric, tariric, gadoleic, arachidonic, cetoleic, fatty acids, as well as the other unsaturated acids such as acrylic, crotonic, etc. Particularly good results have been obtained with mixed unsaturated fatty acid esters, such as are obtained from animal fats and vegetable oils, such as tall oil, linseed oil, olive oil, caster oil, peanut oil, grape oil, fish oil, sperm oil, and so forth.

Exemplary esters include lauryl tallate, methyl oleate, ethyl oleate, lauryl oleate, cetyl oleate, cetyl linoleate, lauryl ricinoleate, oleyl linoleate, lauryl acrylate, styryl acrylate, 2-ethylhexyl acrylate, oleyl stearate, and alkyl glycerides.

Cross-sulfurized ester olefins, such as a sulfurized mixture of $C_{10}$–$C_{25}$ olefins with fatty acid esters of $C_{10}$–$C_{25}$ fatty acids and $C_1$–$C_{25}$ alkyl or alkenyl alcohols, wherein the fatty acid and/or the alcohol is unsaturated may also be used.

Sulfurized olefins are prepared by the reaction of the $C_3$–$C_6$ olefins or a low-molecular-weight polyolefin derived therefrom or $C_8$–$C_{24}$ olefins with a sulfur-containing compound such as sulfur, sulfur monochloride, and/or sulfur dichloride. Particularly preferred are the sulfurized olefins described in U.S. Pat. No. 4,132,659 which is incorporated herein by reference.

Particularly useful are the diparaffin wax sulfides and polysulfides, cracked wax-olefin sulfides and so forth. They can be prepared by treating the starting material, e.g., olefinically unsaturated compounds, with sulfur, sulfur monochloride, and sulfur dichloride. Most particularly preferred are the paraffin wax thiomers described in U.S. Pat. No. 2,346,156.

Sulfurized alkylphenols and the metal salts thereof include compositions such as sulfurized dodecylphenol and the calcium salts thereof. The alkyl group ordinarily contains from 9–300 carbon atoms. The metal salt may be preferably, a group I or group II salt, especially sodium, calcium, magnesium, or barium.

The reaction product of a sulfurized alkylphenol and cracked wax olefin is described in U.S. Pat. No. 4,228,022 which is incorporated herein by reference. The alkyl group present in the alkylphenol preferably contains from 8 to 35 carbon atoms and preferably the olefin contains from 10 to 30 carbon atoms.

Preferred sulfur sources for preparing the molybdenum complexes of component (a) of the combination are sulfur, hydrogen sulfide, phosphorus pentasulfide, $R_2S_x$ where R is hydrocarbyl, preferably $C_{1-10}$ alkyl, and x is at least 3, mercaptans of the formula RSH wherein R is $C_{1-10}$ alkyl, inorganic sulfides and polysulfides, thioacetamide, and thiourea. Most preferred sulfur sources are sulfur, hydrogen sulfide, phosphorus pentasulfide, and inorganic sulfides and polysulfides.

The polar promoter which is preferably used to prepare the molybdenum complex of component (a) of this invention is one which facilitates the interaction between the acidic molybdenum compound and the basic nitrogen compound. A wide variety of such promoters are well known to those skilled in the art. Typical promoters are 1,3-propanediol, 1,4-butanediol, diethyleneglycol, butyl cellosolve, propylene glycol, 1,4-butyleneglycol, methyl carbitol, ethanolamine, diethanolamine, N-methyl-diethanol-amine, dimethyl formamide, N-methyl acetamide, dimethyl acetamide, methanol, ethylene glycol, dimethyl sulfoxide, hexamethyl phosphoramide, tetrahydrofuran and water. Preferred are water and ethylene glycol. Particularly preferred is water.

While ordinarily the polar promoter is separately added to the reaction mixture, it may also be present, particularly in the case of water, as a component of nonanhydrous starting materials or as water of hydration in the acidic molybdenum compound, such as $(NH_4)_6Mo_7O_{24}.4H_2O$. Water may also be added as ammonium hydroxide.

A method for preparing the molybdenum complex of component (a) of this invention is to prepare a solution of the acidic molybdenum precursor and a basic nitrogen-containing compound preferably in the presence of a polar promoter with or without diluent. The diluent is used, if necessary, to provide a suitable viscosity for easy stirring. Typical diluents are lubricating oil and liquid compounds containing only carbon and hydrogen. If desired, ammonium hydroxide may also be added to the reaction mixture to provide a solution of ammonium molybdate. This reaction is carried out at a temperature from the melting point of the mixture to reflux temperature. It is ordinarily carried out at atmospheric pressure although higher or lower pressures may be used if desired. This reaction mixture is treated with a sulfur source as defined above at a suitable pressure and temperature for the sulfur source to react with the acidic molybdenum and basic nitrogen compounds. In some cases, removal of water from the reaction mixture may be desirable prior to completion of reaction with the sulfur source.

In the reaction mixture, the ratio of molybdenum compound to basic nitrogen compound is not critical; however, as the amount of molybdenum with respect to basic nitrogen increases, the filtration of the product becomes more difficult. Since the molybdenum component probably oligomerizes, it is advantageous to add as much molybdenum as can easily be maintained in the composition. Usually, the reaction mixture will have charged to it from 0.01 to 2.00 atoms of molybdenum per basic nitrogen atom. Preferably from 0.4 to 1.0, and most preferably from 0.4 to 0.7, atoms of molybdenum per atom of basic nitrogen is added to the reaction mixture.

The sulfur source is usually charged to the reaction mixture in such a ratio to provide 0.1 to 4.0 atoms of sulfur per atom of molybdenum. Preferably from 0.5 to 3.0 atoms of sulfur per atom of molybdenum is added, and most preferably, 1.0 to 2.6 atoms of sulfur per atom of molybdenum.

The polar promoter, which is optionally and preferably used, is ordinarily present in the ratio of 0.1 to 50 mols of promoter per mol of molybdenum compound. Preferably from 0.5 to 25 and most preferably 1.0 to 15 mols of the promoter is present per mol of molybdenum compound.

Representative of the aromatic amines of component (b) which may be used in combination with the molybdenum complex of component (a) include aromatic amines which contain at least one aryl or arylene group directly attached to at least one nitrogen atom.

Preferably the aromatic amines are N-aryl amines and N,N'-arylene diamines. The aryl and arylene groups preferably contain from 6 to about 14 carbon atoms which latter group includes arylene separated by alkylene, —O—, —CO—, —S— and —$SO_2$— groups. Both the aryl and arylene groups may optionally be substituted by one or more alkyl, cycloalkyl, alkoxy, aryloxy, hydroxy, halogen or nitro radicals. Other atoms or groups which may be bonded to the nitrogen atom along with at least one of the aryl or arylene groups, include hydrogen, alkyl, aralkyl, which latter group may optionally be substituted with one or more hydroxy, alkyl or alkoxy radicals or combinations thereof.

Included within the scope of the N-aryl amines are the amines of the formula

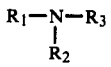

I $R_1$ and $R_2$ are the same or different and each is H, alkyl of 1 to 18 carbon atoms, aryl of 6 to 14 carbon atoms, alkaryl of 7 to 34 carbon atoms or aralkyl of 7 to 12 carbon atoms; $R_3$ is aryl of 6 to 14 carbon atoms, and alkaryl of 7 to 34 carbon atoms. Each of the aryl and substituted aryl groups mentioned in the definition of $R_1$, $R_2$ and $R_3$ may optionally contain one or more alkyl, cycloalkyl, alkoxy, aryloxy, hydroxy, halogen, nitro acyl or acylamido radicals, and combinations thereof.

The preferred N-aryl amines which fall within the scope of the compounds of the formula I are naphthyl amines having the following structure:

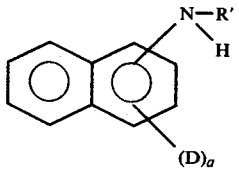

wherein R' is selected from the group consisting of hydrogen, aryl of 6 to 14 carbon atoms, and alkaryl of 7 to 34 carbon atoms, D is alkyl of 1 to 24 carbon atoms and a is 0 or 1, and diphenyl amines having the following structure:

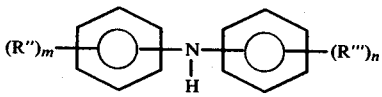

wherein R'' and R''' are alkyl of 1 to 28 carbon atoms, and m and n are 0 or 1.

Included within the scope of N,N'-arylene amines are the amines of the formula

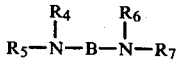

II $R_4$, $R_5$, $R_6$ and $R_7$ are independently selected from the group consisting of hydrogen, alkyl having 1 to 12 carbon atoms, and aryl, aralkyl or alkaryl each having from 6 to about 22 carbon atoms, B is selected from the group consisting of arylene containing 6 to 14 carbon atoms and a group of the formula

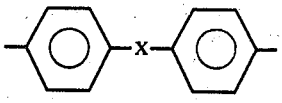

wherein X is a covalent bond, alkylene containing 1 to 8 carbon atoms, —O—, —CO—, —S—, or —$SO_2$—. Substituents which may be present on the divalent group B include one or more alkyl, alkoxy, or halogen radicals and combinations thereof. Preferably, B is phenylene, diphenylene, or a group of the formula

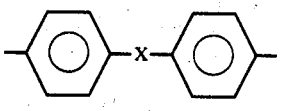

wherein X is a branched or straight chain alkylene of 1 to 8 carbon atoms, —O—, —S—, or —$SO_2$—.

Illustrative of suitable specific amines are N-phenyl-alpha-naphthyl amine; N-phenyl-beta-naphthyl amine; N-octyl-beta-naphthyl amine; diphenylamine; di-alpha-naphthyl amine, di-beta-naphthyl amine; N,N'-diphenyl-p-phenylene diamine; N-p-octyl-phenyl phenyl amine; di-p-octyl diphenyl amine, N,N'-diheptyl-p-phenylene diamine, octylphenyl alpha- or beta-naphthylamine, alpha-alpha, alpha-beta or beta-beta dinaphthylamines, xylyl naphthylamines, dodecyl phenyl naphthylamines, biphenyl naphthylamines and phenyl naphthylamines alkylated with olefins containing from about 8 to about 24 carbon atoms per molecule. (Specific examples of these olefins include pinene, alpha-methylstyrene, and the like), 4-tertiary pentyldiphenylamine, N-p-tertiary pentyl-phenyl-alpha-naphthylamine, N-p-tertiary pentyl-phenyl-beta-naphthylamine, 4-p-(1':1':3':3'-tetramethylbutyl)-dinaphthylamine, N-p-(1:1:3:3:-tetramethylbutyl)-alpha-naphthylamine, N-p-(1:1:3:3-tetramethylbutyl)-phenyl-beta-naphthylamine, 4-p-(1'1':3':3':5':5'-hexamethylhexyl)-diphenylamine, N-p-(1:1:3:3:5:5-hexamethylhexyl)-phenyl-alpha-naphthylamine, N-p-(1:1:3:3:5:5:-hexamethylhexyl)-beta-naphthylamine, alpha or beta naphthylamine, diphenyl amine, phenyl tolyl amine, ditolyl amine, dioctyldiphenyl amine, di-alpha- or beta-naphthylamine, N-phenyl butyl amine, N-phenyl octyl amine, di(biphenyl)amine, di(tert-butylphenyl)amine, (sec-amylphenyl)phenylamine, (methylphenyl)naphthylamine bis(N-sec-butyl-p-aminophenyl)methane, N-isopropyl-N'-phenyl-p-phenylene diamine, N-cyclohexyl-N'-phenyl-p-phenylene diamine, 2,2-bis(p-N,N-dimethylaminophenyl) propane, N-p-t-octylphenyl-alpha-naphthylamine, N-(p-alpha-cumylphenyl)-6-alphacumyl-beta-naphthylamine, N-p-t-octylphenyl-beta-naphthylamine and the corresponding p-t-dodecylphenyl, p-t-butylphenyl, and p-dodecylphenyl-alpha and -beta-naphthylamines, diisobornyl diphenylamine, triphenylamine, p,p'-dioctyldiphenylamine, didecyldiphenylamine, didodecyldiphenylamine, dihexyldiphenylamine, p,p'di-t-octyldiphenylamines, N,N'-diisopropyl diaminodiphenyl methane, N,N'-di-sec-butyl-diaminodiphenyl methane, N,N'-di-sec-amyl-diaminodiphenyl methane, N,N'-di-sec-hexyl-diaminodiphenyl methane, N,N'-di-sec-heptyl-diaminodiphenyl methane, N,N'-di-sec-octyl-diaminodiphenyl methane, N,N'-di-sec-nonyldiaminodiphenyl methane, N,N'-di-sec-decyl-
diaminodiphenyl methane, N,N'-di-sec-undecyl-
diaminodiphenyl methane, N,N'-disec-dodecyl-
diaminodiphenyl methane, N,N'-di-sec-tridecyl-
diaminodiphenyl methane, N,N'-di-sec-tetradecyl-
diaminodiphenyl methane, N,N'-diisopropyl-
diaminodiphenyl ether, N,N'-di-sec-butyl-
diaminodiphenyl ether, N,N'-di-sec-amyl-
diaminodiphenyl ether, N,N'-di-sec-hexyl-
diaminodiphenyl ether, N,N'-di-sec-heptyl-
diaminodiphenyl ether, N,N'-di-sec-octyl-
diaminodiphenyl ether, N,N'-di-sec-nonyl-
diaminodiphenyl ether, N,N'-di-sec-decyl-
diaminodiphenyl ether, N,N'-di-sec-undecyl-
diaminodiphenyl ether, N,N'-di-sec-dodecyl-
diaminodiphenyl ether, N,N'-di-sec-tridecyl-
diaminodiphenyl ether, N,N'-di-sec-tetradecyl-
diaminodiphenyl ether, N,N'-diisopropyl-
diaminodiphenyl sulfide, N,N'-di-secbutyl-
diaminodiphenyl sulfide, N,N'-di-sec-amyl-
diaminodiphenyl sulfide, N,N'-di-sec-hexyl-
diaminodiphenyl sulfide, N,N'-di-sec-heptyl-
diaminodiphenyl sulfide, N,N'-di-sec-octyl-
diaminodiphenyl sulfide, N,N'-di-sec-nonyl-
diaminodiphenyl sulfide, N,N'-di-sec-decyl-
diaminodiphenyl sulfide, N,N'-di-sec-undecyl-
diaminodiphenyl sulfide, N,N'-di-sec-dodecyl-
diaminodiphenyl sulfide, N,N'-di-sec-tridecyl-
diaminodiphenyl sulfide, N,N'-di-sec-tetradecyl-
diaminodiphenyl sulfide.

The lubricating oil compositions containing the additives of this invention can be prepared by admixing, by conventional techniques, the appropriate amount of the sulfur containing molybdenum complex of component (a) and the aromatic amine compound of component (b) with a lubricating oil. The selection of the particular base oil depends on the contemplated application of the lubricant and the presence of other additives. Generally, the amount of the combined additives of components (a) and (b) will vary from 0.05 to 15% by weight and preferably from 0.2 to 10% by weight.

The lubricating oil which may be used in this invention includes a wide variety of hydrocarbon oils, such as naphthenic bases, paraffin bases and mixed base oils as well as synthetic oils such as esters and the like. The lubricating oils may be used individually or in combination and generally have a viscosity which ranges from 50 to 5,000 SUS and usually from 100 to 15,000 SUS at 38° C.

In many instances it may be advantageous to form concentrates of the combination of additives within a carrier liquid. These concentrates provide a convenient method of handling and transporting the additives before their subsequent dilution and use. The concentration of the additive combination within the concentrate may vary from 15 to 90% by weight although it is preferred to maintain a concentration between 15 and 50% by weight. The final application of the lubricating oil compositions of this invention may be in marine cylinder lubricants as in crosshead diesel engines, crankcase lubricants as in automobiles and railroads, lubricants for heavy machinery such as steel mills and the like, or as greases for bearings and the like. Whether the lubricant is fluid or a solid will ordinarily depend on whether a thickening agent is present. Typical thickening agents include polyurea acetates, lithium stearate and the like.

If desired, other additives may be included in the lubricating oil compositions of this invention. These additives include antioxidants or oxidation inhibitors, dispersants, rust inhibitors, anticorrosion agents and so forth. Also antifoam agents stabilizers, antistain agents, tackiness agents, antichatter agents, dropping point improvers, antisquawk agents, extreme pressure agents, odor control agents and the like may be included.

The following examples are presented to illustrate the operation of the invention and are not intended to be a limitation upon the scope of the claims.

EXAMPLES

EXAMPLE 1

To a 1-liter flask were added 290 grams of a solution of 45% concentration in oil of the succinimide prepared from polyisobutenyl succinic anhydride and tetraethylene pentaamine and having a number average molecular weight for the polyisobutenyl group of about 980, and 150 ml hydrocarbon thinner. The mixture was heated to 65° C. and 28.8 grams molybdenum trioxide, and 50 ml water were added. The temperature was maintained at 65° C. for ½ hour and increased to 150° C. over a period of 55 minutes. To the mixture was added 7 grams elemental sulfur and 100 ml of hydrocarbon thinner. The reaction mixture was maintained at reflux at approximately 155° C. for 45 minutes and then the temperature was increased to 165° C. to 170° C. and held there for two hours. To the mixture was added 50 ml of hydrocarbon thinner and the reaction mixture was filtered hot through diatomaceous earth. The filtrate was stripped to 160° C. at 20 mm Hg to yield 316.5 grams of product containing 6.35% molybdenum, 3.57% oxygen, 1.86% nitrogen, 2.15% sulfur.

EXAMPLE 2

To a 3-liter flask were added 1160 grams of a polyamide prepared from a $C_{18}$ carboxylic acid and tetraethylenepentaamine and containing 6.29% nitrogen and 800 ml hydrocarbon thinner. The mixture was heated to 65° C. and 200 ml of water and 116 grams $MoO_3$ was added. The temperature was raised to reflux, approximately 95° C., and held at this temperature for 4 hours until the solution became clear green. The solvent was removed to 150° C. maximum and the mixture was then cooled to 140° C. and 28 grams sulfur was added. The temperature was raised to 155° C. over a period of ¼ hour and held at this temperature for ½ hour. The temperature was again increased to 175° C. over a period of 20 minutes and then held at between 175° and 180° C. for 2 hours. The mixture was cooled and left overnight and then 200 ml hydrocarbon solvent was added. The mixture was heated to 130° C., filtered through diatomaceous earth and then stripped to 180° C. bottoms at 20 mm Hg to yield 1282 grams of product containing 5.45% nitrogen, 2.15% sulfur, 5.51% molybdenum, and 5.73% oxygen.

EXAMPLE 3

To a 1-liter flask were added 290 grams of a Mannich base prepared from dodecylphenol, methylamine and formaldehyde and having an alkalinity value of 110 and containing 2.7% nitrogen, and 200 ml of a hydrocarbon thinner. The mixture was heated to 65° C. and 50 ml water and 29 grams of molybdenum trioxide were added. The mixture was stirred at reflux, 104° to 110° C., for 4½ hours. The solution became a clear dark brown color and then was stripped to 175° C. bottoms. The mixture was cooled to 140° C. and 7 grams sulfur was added. The temperature was increased to 155° C. over a period of 7 minutes and held at this temperature for ½ hour. The temperature was then increased to 180° C. over a period of 10 minutes and held for 2 hours. The mixture was then cooled and left overnight. The next day 100 ml of hydrocarbon solvent was added. The mixture was heated to 100° C. and filtered through diatomaceous earth and then stripped to 180° C. at 20 mm Hg to yield 317 grams of product.

EXAMPLE 4

To a 1-liter flask containing 300 g of a borated Mannich base prepared from a $C_{80-100}$ alkylphenol, formaldehyde and tetraethylene pentaamine or triethylene tetraamine, or mixtures thereof and containing urea (Amoco 9250) and 200 ml hydrocarbon thinner at 65° C. were added 40 ml water and 25 g $MoO_3$. The mixture was stirred at reflux for 4.5 hours and then stripped to 165° C. After cooling to 140° C., 7 g sulfur was added and the temperature was gradually increased to 185° C. where it was held for 2 hours. Then, 75 ml hydrocarbon thinner was added and the mixture was filtered through diatomaceous earth and then stripped to 180° C. at 20 mm Hg to yield 307 g product containing N, 1.04%; S, 2.53%; Mo, 4.68% Neutron Activation (N.A.), 4.99% X-Ray Fluorescence Spectroscopy (XRF); O, 2.53%; B, 0.22%.

EXAMPLE 5

To a 3-liter flask were added 500 g of a concentrate of polyisobutenyl succinic anhydride wherein the polyisobutenyl group had a number average molecular weight of about 980 and 36 g dimethyl aminopropylamine. The temperature of the reaction mixture was increased to 160° C., held there for 1 hour and then stripped to 170° C. at 20 mm Hg. To this mixture were added 350 ml hydrocarbon thinner, 50 ml water, and 29 g $MoO_3$. This mixture was stirred at reflux for 2 hours and then stripped to 140° C. to remove water. Then 7 g of sulfur was added and the mixture was held at 180°–185° C. for 2 hours. After cooling, additional hydrocarbon thinner was added and the mixture was filtered through diatomaceous earth, and then stripped to 180° C. at 20 mm Hg to yield 336 g product containing N, 1.17%; S, 1.55%; Mo, 3.37% (N.A.), 3.31% (XRF); O, 2.53%.

EXAMPLE 6

To a 1-liter flask containing 290 g of the succinimide described in Example 1 and 200 ml of hydrocarbon thinner at 65° C. were added 50 ml water and 29 g $MoO_3$. The mixture was stirred at reflux for 1.5 hours and then stripped to 165° C. to remove water. After cooling to 100° C., 40 g butyldisulfide was added and the mixture was heated to 180°–185° C. for 2.5 hours. Then an additional 100 ml hydrocarbon thinner was added before filtering through diatomaceous earth and stripping to 180° C. at 20 mm Hg to yield 305 g of product containing N, 1.90%; S, 0.47%; Mo, 6.21% (N.A.), 6.34% (XRF); O, 4.19 (N.A.).

EXAMPLE 7

To a 1-liter flask containing 290 g of the succinimide described in Example 1 and 200 ml hydrocarbon thinner at 75° C. were added 50 ml water and 29 g $MoO_3$. The mixture was refluxed for 1.5 hours and then stripped to 200° C. to remove water. After cooling to 100° C., 19 g thioacetamide was added and the mixture was gradually heated to 200° C. where it was held for 0.75 hour. Then, 150 ml hydrocarbon thinner was added and the mixture was filtered through diatomaceous earth and stripped to 180° C. at 20 mm Hg, to yield a product containing N, 1.46%; S, 2.05%; Mo, 4.57% (N.A.), 4.70% (XRF); O, 2.38%. Before testing, this product was diluted with 100 g neutral lubricating oil.

EXAMPLE 8

To a 1-liter flask containing 290 g of a solution of 45% concentrate in oil of the succinimide prepared from polyisobutenyl succinic anhydride and tetraethylene pentaamine and having a number average molecular weight for the polyisobutenyl group of about 980 and 200 ml hydrocarbon thinner at 75° C. was added 50 ml water and 29 g $MoO_3$. The mixture were stirred at reflux for 1.5 hours and then heated to 187° C. to remove water. Then 100 ml hydrocarbon thinner was added and, at 75° C., 34 g of aqueous ammonium polysulfide (31% free sulfur). This mixture was slowly heated to 180° C. and held there for 2.25 hours. It was then filtered through diatomaceous earth and stripped to 180° C. at 20 mm Hg to yield 318 g of product containing N, 1.89%; S, 4.07%; Mo, 6.16% (N.A.).

EXAMPLE 9

To a 1-liter flask containing 290 g of the succinimide described in Example 1 and 200 ml hydrocarbon thinner at 75° C. were added 50 ml water and 29 g $MoO_3$. The mixture was stirred at 96°–98° C. for 2½ hours and then stripped at 191° C. After cooling to 75° C., 43 ml 1-butanethiol was added and the mixture was refluxed for 14 hours. The mixture was then stripped to 180° C. at 20 mm Hg to yield 318 g product containing Mo, 6.17% (XRF); N, 1.97%; S, 1.05%.

EXAMPLE 10

A. The oxidation stability of lubricating oil compositions containing the additive combination prepared according to this invention were tested in an Oxidator B Test. According to this test, the stability of the oil is measured by the time in hours required for the consumption of 1 liter of oxygen by 100 grams of the test oil at 340° F. In actual test, 25 grams of oil is used and the results are corrected to 100-gram samples. The catalyst which is used at a rate of 1.38 cc per 100 cc oil contains a mixture of soluble salts providing 95 ppm copper, 80 ppm iron, 4.8 ppm manganese, 1100 ppm lead and 49 ppm tin. The results of this test are reported as hours to consumption of 1 liter of oxygen and is a measure of the oxidative stability of the oil.

The base Formulation tested in Table 1 contained in a neutral lubricating oil, 1.5% of a 50% concentrate of a polyisobutenyl succinimide, 8 m moles/kg dialkyl zinc dithiophosphate from sec-butanol and methylisobutylcarbinol, 30 m moles/kg overbased magnesium sulfonate, 20 m moles/kg overbased sulfurized calcium alkyl phenate and 5.5% polymethacrylate V.I. improver.

TABLE 1

Oxidator B Test
Time In Hours for Consumption of One Liter of Oxygen per 100 grams Oil

| Composition | Hours |
|---|---|
| Base Formulation | 5.9 |
| 6 m moles/kg Molybdenum Complex of Example 1 | 10.5 |
| 0.5% diisobornyldiphenylamine | 5.7 |
| 6 m moles/kg Molybdenum Complex of Example 1 + 0.5% diisobornyldi- | 15.1 |

TABLE 1-continued

| Oxidator B Test Time In Hours for Consumption of One Liter of Oxygen per 100 grams Oil | |
|---|---|
| Composition | Hours |
| phenylamine | |
| 0.5% p,p'-dioctyldiphenylamine | 7.1 |
| 6 m moles/kg Molybdenum Complex of Example 1 + 0.5% p,p'-dioctyldiphenylamine | 20.5 |

In a similar manner, when the molybdenum complexes of Examples 2 through 9 are substituted for the molybdenum complex of Example 1 in the above test, the oxidation stability of the oil formulations containing the combinations of this invention are enhanced as compared to the oil formulations not containing the additive combination.

B. The compositions of Table 2 were tested by a variation of the "Oxidator B" test. In this test, the catalyst consists of 95 ppm of oil soluble copper and 80 ppm of oil soluble iron. The rate of oxygen uptake is plotted as ordinate with time as the abscissor. The 1st sharp break in this plot is taken as the induction period and is reported as such.

TABLE 2

| Oxidation Stabilization | | | |
|---|---|---|---|
| Run No. | Phenyl-alpha-naphthal-amine Conc. mm/kg | Molybdenum Complex(1) mm/kg | Induction Time Hrs.(2) |
| 1 | 0 | 10 | 0.60 |
| 2 | 0.114 | 0 | 0.35 |
| 3 | 0.228 | 0 | 0.60 |
| 4 | 0.456 | 0 | 1.30 |
| 5 | 2.28 | 0 | 3.55 |
| 6 | 2.28 | 0.40 | 35.65 |
| 7 | 2.28 | 0.50 | 34.00 |
| 8 | 2.28 | 0.75 | 33.90 |
| 9 | 0.228 | 1.0 | 5.20 |
| 10 | 2.28 | 1.0 | 48.60 |
| 11 | 0.114 | 2.0 | 2.70 |
| 12 | 0.228 | 2.0 | 5.00 |
| 13 | 0.456 | 2.0 | 10.70 |
| 14 | 2.28 | 2.0 | 51.60 |
| 15 | 10.0(3) | 1.0 | 0.65 |

The molybdenum complex prepared according to
(1)Example 1 contained 5.8% molybdenum and 4.5% sulfur.
(2)Time in hours to the inflection point in a plot of oxygen uptake vs. time.
(3)Octadecylamine.

EXAMPLE 11

Formulated oil containing the additives shown in Table 2 were prepared and tested in a Sequence IIID test method (according to ASTM Special Technical Publication 315H). The Formulations were prepared by adding each of the components directly to the oil with stirring.

The purpose of the test is to determine the effect of the additives on the oxidation rate of the oil in an internal combustion engine at relatively high temperatures (about 149° C. bulk oil temperature during testing).

In this test, an Oldsmobile 350 CID engine was run under the following conditions:

Runs at 3,000 RPM/max. run time for 64 hours and 100 lb load;
Air/fuel* ratio=16.5/1, using *GMR Reference fuel (leaded);
Timing=31° BTDC;
Oil temperature=300° F.;
Coolant temperature in=235° F.-out 245° F.;
30" of water of back pressure on exhaust;
Flow rate of jacket coolant=60 gal/min.;
Flow rate of rocker cover coolant=3 gal/min.;
Humidity must be kept at 80 grains of $H_2O$;
Air temperature controlled equal inlet equal 80° F.;
Blowby Breather Heat exchanger at 100° F.

The effectiveness of the additive is measured after 64 hours in terms of the viscosity increase.

The comparisons were made in a formulated base neutral oil containing 30 m moles/kg of a calcium sulfonate, 8 m moles/kg dialkyl zinc dithiophosphate 20 m moles/kg of a calcium phenate and 5.5% of a polymethacrylate V.I. improver.

TABLE 3

| Formulation | % Viscosity After 40 Hr | Increase After 64 Hr |
|---|---|---|
| Base formulation | Too viscous to measure | Too viscous to measure |
| 3 m moles/kg Molybdenum Complex of Example 1 | 120 | 2914 |
| 3 m moles/kg Molybdenum Complex of Example 1 + 0.5% p,p'-dioctyldiphenylamine | 35 | 92 |
| 0.5% p,p'-dioctyldiphenylamine | — | Too viscous to measure |

What is claimed is:

1. A lubricating oil additive comprising a combination of (a) an oil soluble sulfur containing molybdenum complex prepared by (1) reacting an acidic molybdenum compound and a basic nitrogen compound selected from the group consisting of a succinimide, carboxylic acid amide, Mannich base, phosphonamide, thiophosphonamide, phosphoramide, dispersant viscosity index improvers, or mixtures thereof to form a molybdenum complex wherein from 0.01 to 2 atoms of molybdenum are present per basic nitrogen atom, and (2) reacting said complex with a sulfur containing compound in an amount to provide 0.1 to 4 atoms of sulfur per atom of molybdenum, and (b) an oil soluble aromatic amine compound or mixtures thereof, wherein the aromatic amine compound of component (b) is present in an amount of from 0.02 to 10 parts by weight per part by weight of the sulfur containing molybdenum complex of component (a).

2. The oil additive of claim 1 wherein the aromatic amine of component (b) is selected from the group consisting of an N-aryl amine and an N,N'-arylene diamine.

3. The oil additive of claim 2, wherein the N-arylamine has the formula

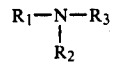

wherein $R_1$ and $R_2$ are the same or different and each is hydrogen, alkyl of 1 to 18 carbon atoms, aryl of 6 to 14 carbon atoms, alkaryl of 7 to 34 carbon atoms or aralkyl of 7 to 12 carbon atoms; $R_3$ is aryl of 6 to 14 carbon atoms or alkaryl of 7 to 34 carbon atoms.

4. The oil additive of claim 2 wherein the N,N'-arylene diamine has the formula

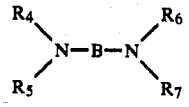

wherein $R_4$, $R_5$, $R_6$ and $R_7$ are the same or different and each is hydrogen, alkyl of 1 to 12 carbon atoms, aryl, aralkyl, or alkaryl having from 6 to 22 carbon atoms, and B is selected from the group consisting of arylene containing 6 to 14 carbon atoms and a group of the formula

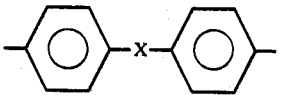

wherein X is a covalent bond, alkylene containing 1 to 8 carbon atoms, —O—, —CO—, —S—, or —$SO_2$—.

5. The additive of claim 2 wherein the N-arylamine is selected from the group consisting of N-phenyl-alphanaphthylamine, p,p'-dioctyldiphenylamine and diisobornyldiphenylamine.

6. The oil additive of claim 1 wherein the sulfur source used to prepare the molybdenum complex of component (a) is sulfur, hydrogen sulfide, phosphorus pentasulfide, $R_2S_x$ where R is hydrocarbyl, and x is at least 2, inorganic sulfides or inorganic polysulfides, thioacetamide, thiourea, mercaptans of the formula RSH where R is hydrocarbyl, or a sulfur-containing antioxidant.

7. The oil additive of claim 6 wherein the sulfur source used to prepare the molybdenum complex of component (a) is sulfur, hydrogen sulfide, phosphorus pentasulfide, $R_2S_x$ where R is $C_{1-40}$ hydrocarbyl, and x is at least 3, inorganic sulfides, or inorganic polysulfides, thioacetamide, thiourea or RSH where R is $C_{1-40}$ alkyl, and the acidic molybdenum compound is molybdic acid, molybdenum trioxide, or ammonium molybdate.

8. The oil additive of claim 7 wherein the sulfur source used to prepare the molybdenum complex of component (a) is sulfur, hydrogen sulfide, RSH where R is $C_{1-10}$ alkyl, phosphorus pentasulfide, or $(NH_4)_2S_{x'}$, where x' is at least 1, said acidic molybdenum compound is molybdic acid, molybdenum trioxide, or ammonium molybdate, and said basic nitrogen compound is a succinimide, carboxylic acid amide, or Mannich base.

9. The oil additive of claim 8 wherein said basic nitrogen compound is a $C_{24-350}$ hydrocarbyl succinimide, carboxylic acid amide, or a Mannich base prepared from a $C_{9-200}$ alkylphenol, formaldehyde, and an amine.

10. The oil additive of claim 9 wherein said basic nitrogen compound is a polyisobutenyl succinimide prepared from polyisobutenyl succinic anhydride and tetraethylene pentaamine or triethylene tetraamine.

11. The oil additive of claim 9 wherein said basic nitrogen compound is a carboxylic acid amide prepared from one or more carboxylic acids of the formula $R^2COOH$, or a derivative thereof which upon reaction with an amine yields a carboxylic acid amide, wherein $R^2$ is $C_{12-350}$ alkyl or $C_{12-350}$ alkenyl and a hydrocarbyl polyamine.

12. The oil additive of claim 11 wherein $R^2$ is $C_{12-20}$ alkyl or $C_{12-20}$ alkenyl and the hydrocarbyl polyamine is tetraethylene pentaamine or triethylene tetraamine.

13. The oil additive of claim 8 wherein said basic nitrogen compound is a Mannich base prepared from dodecylphenol, formaldehyde, and methylamine.

14. The additive of claim 9 wherein said basic nitrogen compound is a Mannich base prepared from $C_{80-100}$ alkylphenol, formaldehyde and triethylene tetraamine, or tetraethylene pentaamine, or mixtures thereof.

15. The oil additive of claim 1 comprising a combination of (a) an oil soluble sulfur containing molybdenum complex prepared by (1) reacting a $C_{24-350}$ hydrocarbyl succinimide, and an acidic molybdenum compound selected from the group consisting of molybdic acid, molybdenum trioxide and ammonium molybdate, and (2) reacting said complex with a sulfur compound selected from the group consisting of sulfur and hydrogen sulfide, and (b) an oil soluble aromatic amine compound selected from the group consisting of N-phenyl-alpha-naphthylamine, p,p'-dioctyldiphenylamine and diisobornyldiphenylamine.

16. The oil additive of claim 15 wherein the hydrocarbyl succinimide is a polyisobutenyl succinimide prepared from polyisobutenyl succinic anhydride and tetraethylene pentaamine or triethylene tetraamine, the sulfur source used to prepare the molybdenum complex is sulfur.

17. A lubricating oil composition comprising an oil of lubricating viscosity and from 0.05 to 15 percent by weight of the additive of claim 1, 2 or 3.

18. A lubricating oil concentrate composition comprising an oil of lubricating viscosity and from 15 to 90 percent by weight of the product of claim 1, 2 or 3.

* * * * *